US006186218B1

(12) United States Patent
Prieto

(10) Patent No.: US 6,186,218 B1
(45) Date of Patent: Feb. 13, 2001

(54) MODULAR WHEEL MOLD

(75) Inventor: Romulo A. Prieto, Northville, MI (US)

(73) Assignee: Hayes Lemmerz International, Inc., Northville, MI (US)

( * ) Notice: Under 35 U.S.C. 154(b), the term of this patent shall be extended for 0 days.

(21) Appl. No.: 09/270,624

(22) Filed: Mar. 17, 1999

Related U.S. Application Data

(60) Provisional application No. 60/078,338, filed on Mar. 17, 1998.

(51) Int. Cl.[7] ..... B22D 33/04
(52) U.S. Cl. ..... 164/339; 164/340; 164/341
(58) Field of Search ..... 164/137, 339, 164/340, 341

(56) References Cited

U.S. PATENT DOCUMENTS 4,795,125 1/1989 Boros et al. ..... 249/78
5,381,852 1/1995 Schilling ..... 164/137
5,595,771 1/1997 Foltuz et al. ..... 425/443
5,662,946 9/1997 Pratt et al. ..... 425/190
5,832,983 * 11/1998 Kuroda et al. ..... 164/137

* cited by examiner

*Primary Examiner*—Harold Pyon
*Assistant Examiner*—Ing-Hour Lin
(74) *Attorney, Agent, or Firm*—MacMillan, Sobanski & Todd, LLC

(57) ABSTRACT

An assembled mold base member for a wheel component includes a universal base support member which is combined with one of a plurality of interchangeable center members to form an assembled mold base. The assembled mold base cooperates with an assembled top core having an interchangeable end member combined with one of a plurality of universal top core members and side members to form the wheel component mold.

10 Claims, 6 Drawing Sheets

MODULAR WHEEL MOLD

CROSS REFERENCE TO RELATED APPLICATIONS

This application claims the benefit of U.S. Provisional Application Ser. No. 60/078,338, filed on Mar. 17, 1998.

BACKGROUND OF THE INVENTION

This invention relates in general to multiple-piece molds for forming vehicle wheels and in particular to a multiple-piece mold having interchangeable components and a process for forming wheels which utilizes such a mold.

In the past, vehicle wheels typically have been formed entirely from steel. However, wheels formed from light weight metals, such as aluminum, magnesium and titanium, or alloys thereof, are becoming increasingly popular. In addition to weighing less than conventional all-steel wheels, such light weight wheels can be manufactured having a pleasing esthetic shape. Weight savings also can be achieved by attaching a wheel disc formed from a light weight metal alloy to a steel wheel rim.

Light weight wheels are typically formed by casting or forging operations. Conventional casting operations include numerous processes, such as die casting, low pressure injection casting and gravity casting. Conventional casting operations typically utilize a wheel mold formed from a number of pieces. A wheel mold for casting a one piece vehicle wheel defines a mold cavity which includes a rim cavity for casting a rim portion of the vehicle wheel and a disc cavity for casting a disc portion of the vehicle wheel. During a casting operation, molten metal is poured into the mold cavity and flows into the rim and disc cavities. After the metal cools sufficiently to solidify, the mold is opened and a rough wheel casting is removed. The wheel casting is then machined to a final shape. Machining can include turning the outside and inside surfaces of the wheel rim, facing the inboard and outboard wheel disc surfaces and drilling a center pilot hole and mounting holes through the wheel hub.

For high volume production of vehicle wheels, a highly automated gravity casting process is frequently used. Such automated gravity casting processes typically use a casting machine having a plurality of wheel molds mounted upon a moving structure, such as a rotatable carousel. Each wheel mold is indexed past a refractory furnace containing a pool of molten metal. A charge of molten metal is removed from the furnace pool and poured into a gate formed in the mold. The gate communicates with the mold cavity and gravity causes the metal to flow from the gate into the mold cavity, filling the rim and disc cavities. The mold and the molten metal cool as the casting machine indexes the other molds to the refractory furnace for charging with molten metal. Alter a sufficient cooling time has elapsed, the mold is opened and the wheel casting removed. The mold is then closed and again indexed to the refractory furnace to be refilled with molten metal.

Referring now to the drawings, there is illustrated in FIGS. 1 and 2 a typical prior art multiple-piece wheel mold, which is shown generally at 10. The mold 10 is formed from a high temperature resistant metal, such as steel. The mold 10 includes an annular shaped base 11 which supports the other mold members. The base 11 has a base member 12 which is typically formed as a single piece. The base member 12 has an upper surface 13 which is stylistically shaped to form the outboard face of the disc portion of the wheel casting. As shown in FIG. 1, the base 11 also can include a number of mold components which are attached to the base member 12.

The mold 10 further includes a pair of movable side members 15 and 16 which are supported by the base 11. While two side members 15 and 16 are shown in FIG. 1, it will be appreciated that the mold 10 can include more than two side members. The side members 15 and 16 are movable in a horizontal direction in FIG. 1 and can be extended to a closed position, which is illustrated in FIG. 1, or retracted to an open position by a conventional mechanism which, for clarity, is not shown in FIG. 1. The side members 15 and 16 are shown partially retracted in FIG. 2. The side member 16, which is shown on the right in FIG. 1, has a gate 17 formed therein. A plurality of passageways extend from the gate 17 through the inner surface of the right side member 16.

The mold 10 also includes a top core 20 which is disposed between the side members 15 and 16. The top core 20 can be extended and retracted in a vertical direction, as illustrated in FIG. 2, where the top core 20 is partially retracted. Typically, the top core 20 has a central member 21 which is typically formed as a single piece. Similar to the base member 12, the top core 20 has a lower surface 21 which is stylistically shaped to form the inboard face of the disc portion of the wheel casting. As shown in FIG. 1, the top core 20 also can include a number of mold components which are attached to the central member 21.

When the mold 10 is closed, as shown in FIG. 1, the mold 10 defines a mold cavity 25 having a rim cavity 26 for forming the rim portion of the vehicle wheel and a disc cavity 27 for forming the disc portion of the vehicle wheel. The mold cavity 25 communicates with the gate 17 through the passageways formed through the inner surface of the right side member 16. During casting, the gate 17 receives a charge of molten metal for casting the wheel and feeds the charge into the mold cavity 25 filling the rim and disc cavities 26 and 27. Following solidification of the molten metal in the mold cavity 25, the side members 15 and 16 and top core 20 are fully retracted to allow removal of the wheel casting from the mold base 12.

As described above, the casting process allows the wheel disc to be stylized. Increasingly, stylists are designing distinctive wheels for specific vehicles and also for different trim lines of the same vehicle. As also described above, the wheel disc is formed by the cooperation of the stylized lower surface 22 of the top core 20 and the stylized upper surface 13 of the base member 12. Accordingly, a complete mold is typically constructed for each wheel design. For mass production with the automated casting process, a set of complete wheel molds are typically fabricated for each wheel design. The molds arc then stored between production runs of the wheel.

SUMMARY OF THE INVENTION

This invention relates to a multiple-piece mold having interchangeable components and a process for forming wheels which utilizes such a mold.

As described above, there is a growing demand for custom designed wheels which are cast for a particular vehicle. However, the fabrication of complete wheel molds typically requires 20 to 30 weeks, delaying production of prototype wheels once the design is completed. Additionally, production runs are similarly delayed while additional molds are fabricated for the automated casting machines. Accordingly, it would be desirable to reduce the amount of time need to prepare the wheel molds.

The present invention contemplates a multiple piece form for forming a vehicle wheel component which includes a universal ring-shaped base support member with a removable disc-shaped base center member mounted thereupon to form a base member assembly. The form also includes a top core member. The base center member is one of a plurality of interchangeable base core members having a stylized shape. The base member assembly cooperates with the top core end member to form a stylized wheel disc.

The invention further contemplates that the top core includes a stylized top core end member mounted upon a universal annular top core member with the top core end member cooperating with the top universal top core member to form a top core assembly. The top core end member is one of a plurality of interchangeable top core end members.

In the preferred embodiment, the base center member is formed having a beveled edge and the base support member is formed having a beveled edge which is complementary to the beveled edge of said base center member. The base center member beveled edge cooperates with said base support member beveled edge to form a joint between the base center member and the base support member. Alternately, the base center member can include a stepped edge and the base support member can include a stepped edge which is complementary to the stepped edge of said base center member. The base center member stepped edge cooperates with the base support member stepped edge to form a joint between the base center member and the base support member.

The base member assembly can cooperate with the top core assembly to form a mold for casting a vehicle wheel disc. The invention further contemplates a plurality of side members which cooperate with the base member assembly and the top core assembly to form a mold for casting a vehicle wheel. Alternately, the base member assembly can cooperate with the top core assembly to form a die set for forging a vehicle wheel disc. The die set also can include side members which cooperate with the base member assembly and the top core assembly to form a die set for forging a vehicle wheel.

The invention also contemplates a process for forming a wheel component which includes providing a ring shaped universal base support member and selecting one of a plurality of interchangeable disc-shaped base center members which is then mounted upon the universal base to form an assembled base member. The assembled base member cooperates with a top core to form the wheel component. The wheel component may be formed by casting or forging. Additionally, the top core can be assembled by mounting one of a plurality of top core end members upon an annular universal top core member to form a top core assembly. Furthermore, a plurality of side members can cooperate with the bottom member assembly and the top core assembly for casting or forging a vehicle wheel.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
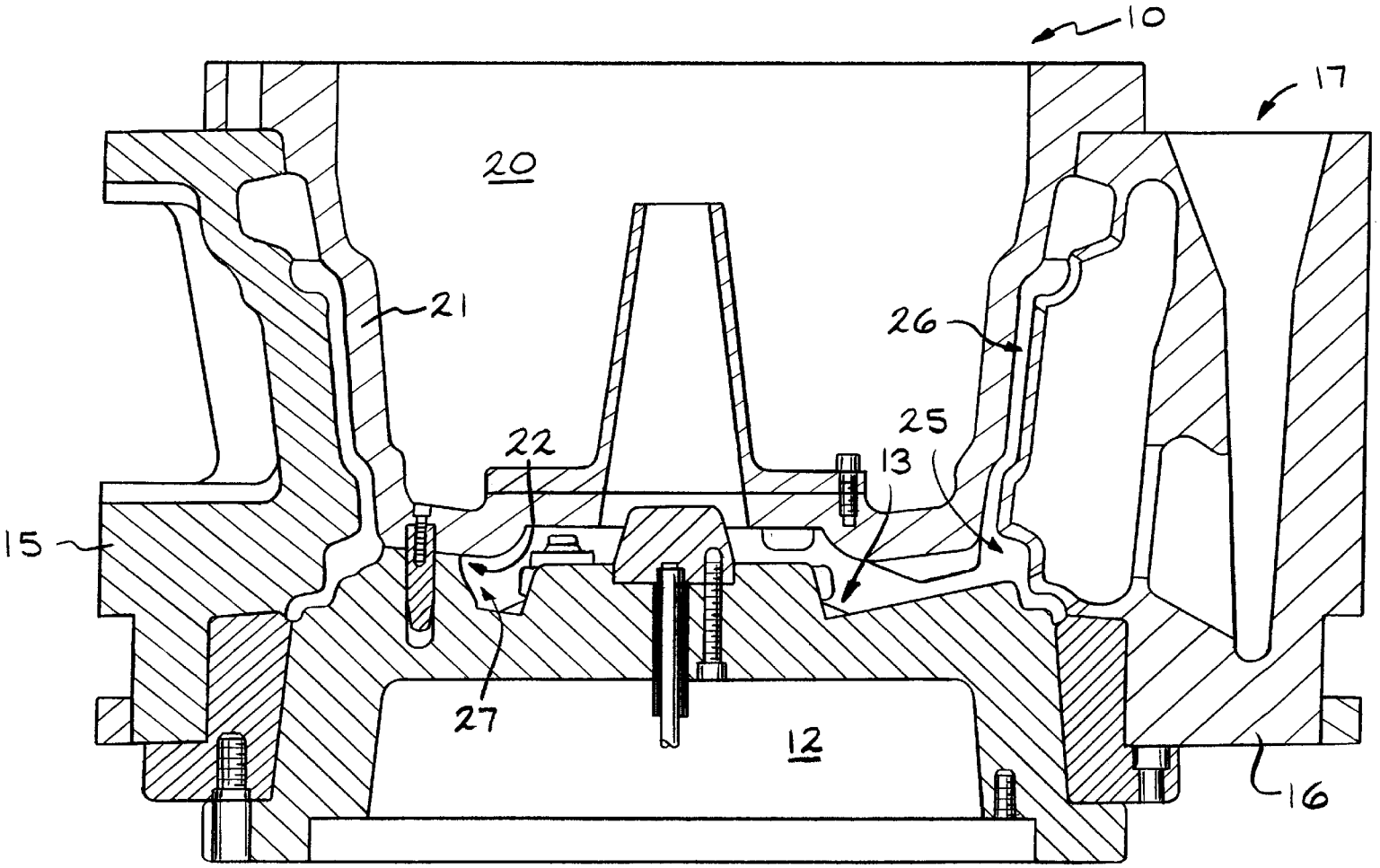
FIG. 1 (PRIOR ART)
FIG. 1 is a sectional view of a typical prior art mold for casting a vehicle wheel.
Figure 2:
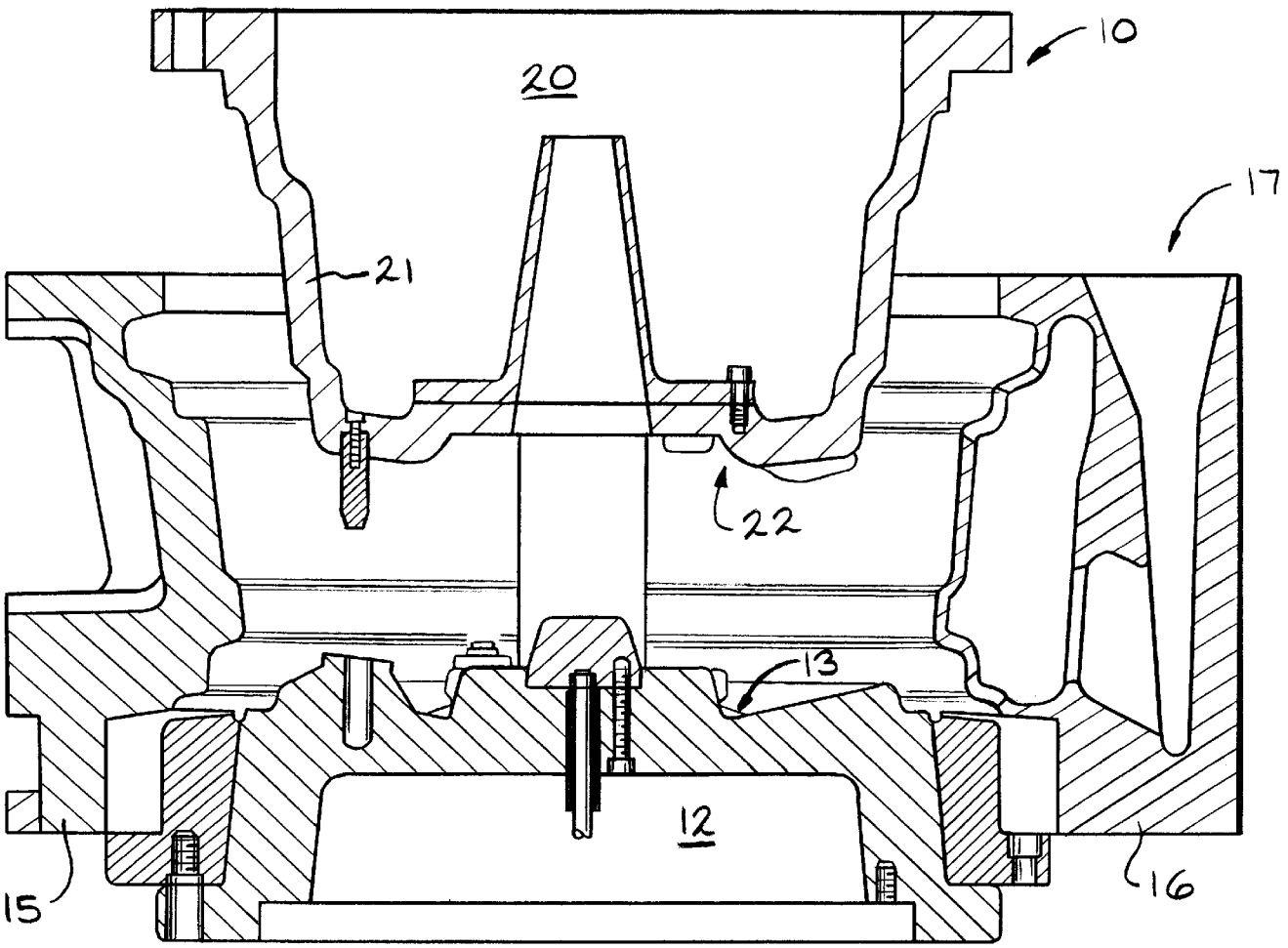
FIG. 2 (PRIOR ART)
FIG. 2 is a sectional view of the mold shown in FIG. 1 with the mold elements partially retracted.
Figure 3:
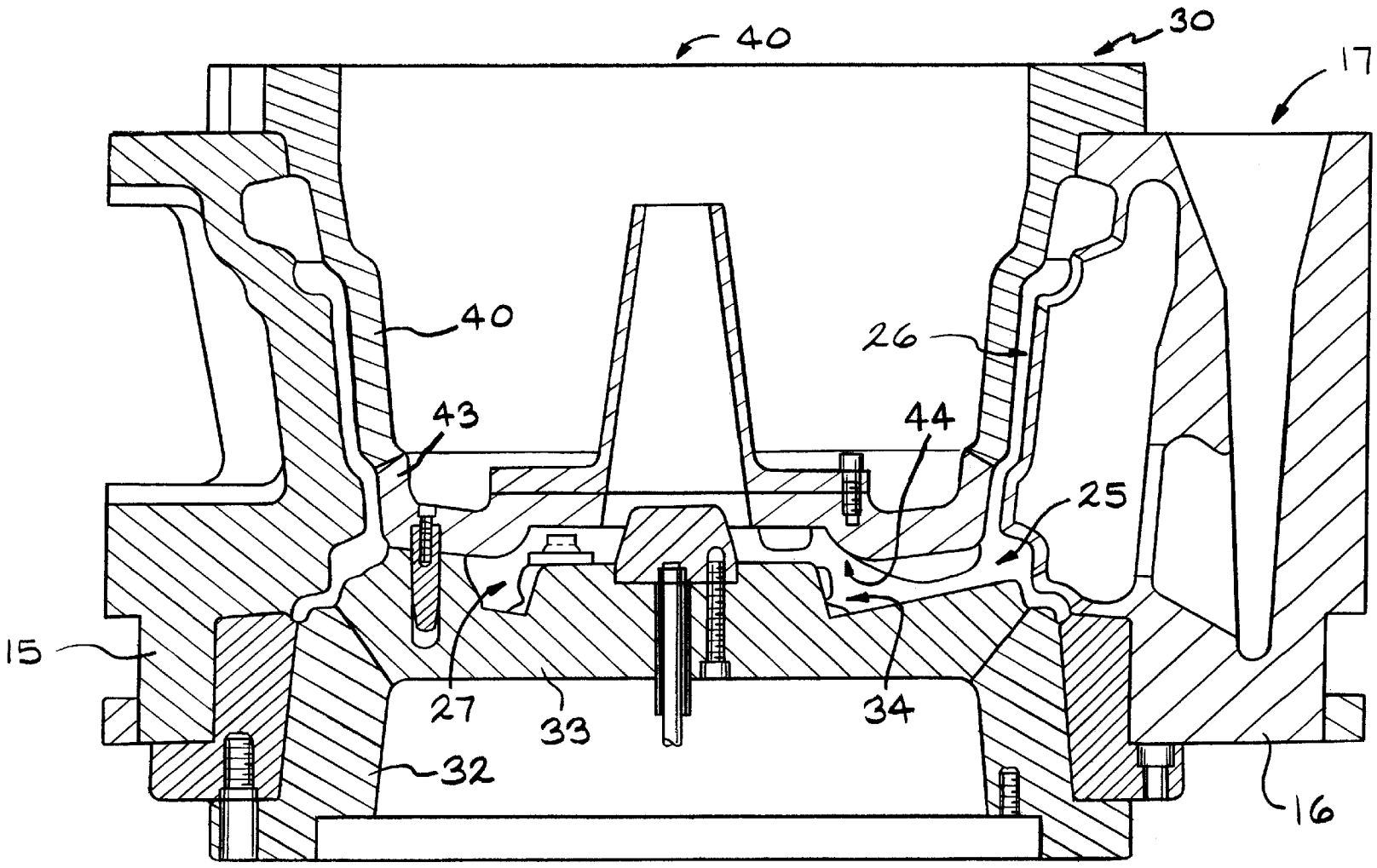
FIG. 3 is a sectional vehicle wheel mold which includes modular components in accordance with the present invention.
Figure 4:
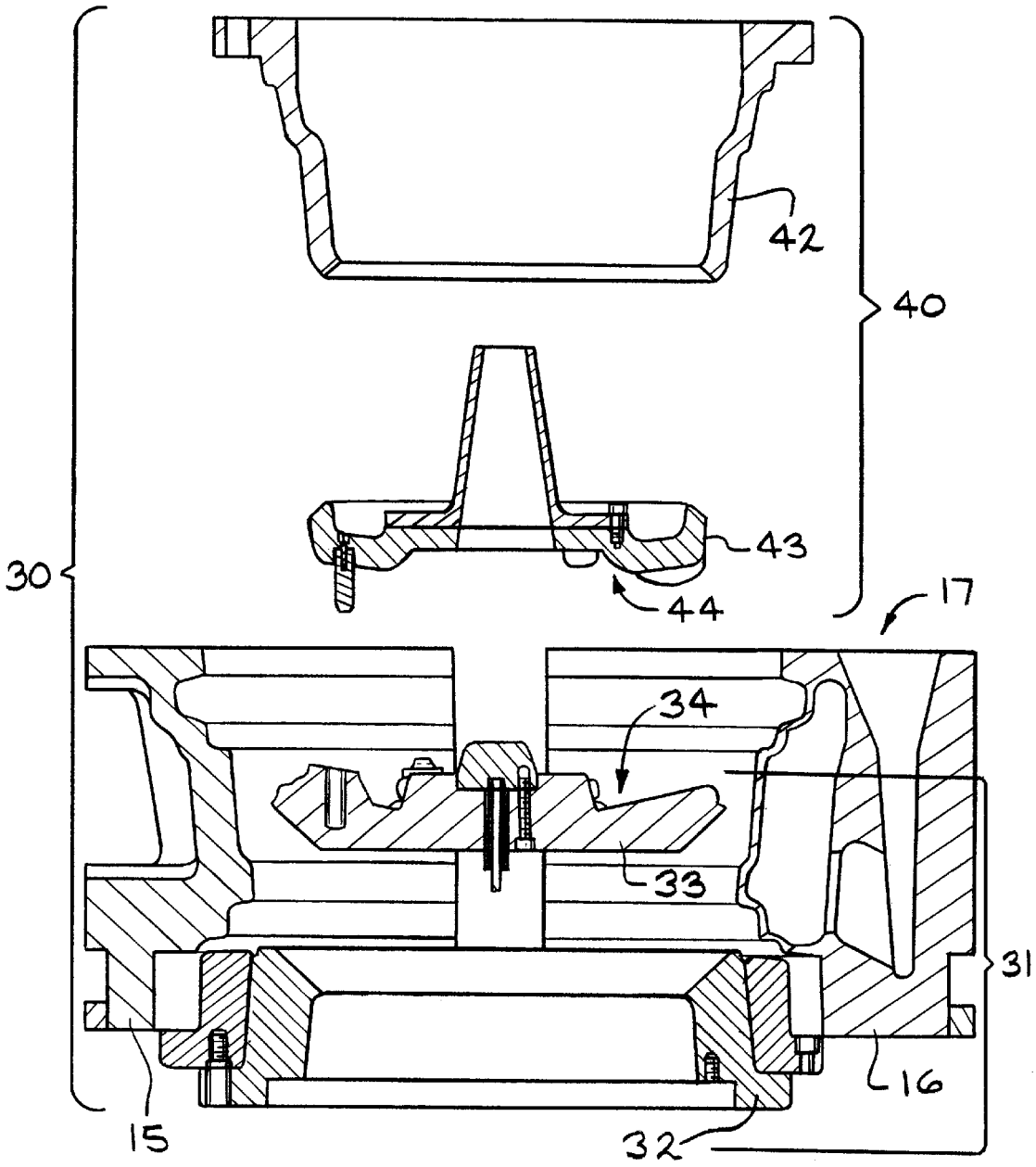
FIG. 4 is a sectional view of the mold shown in FIG. 3 with the mold elements partially retracted and the modular components separated from their corresponding mold members.

The present invention contemplates a multiple-piece wheel mold having modular components which are used to form the stylized portions of the wheel disc. Referring again to the drawings, there is illustrated in FIGS. 3 and 4 a modular wheel mold, shown generally at 30, in accordance with the invention. Components of the wheel mold 30 which are similar to components shown in FIGS. 1 and 2 have the same numerical designators. The components of the mold 30 are formed from conventional mold materials, such as, for example, ferrous or nonferrous steel, graphite, or aluminum for casting plastic.

The mold 30 includes an annular shaped base 31 which supports the other mold members. The base 31 includes a ring-shaped universal base support member 32 and a removable disc-shaped base center member 33 which is mounted upon the base support member 32. In the preferred embodiment, the base center member 33 is secured to the base support member 32 with conventional threaded fasteners (not shown); however, other conventional methods can be utilized to secure the center member 33 to the support member 32. Alternately, the base center member 33 can be clamped to the support member 32. As shown in FIG. 3, additional mold components can be attached to the support and center members 32 and 33 of the mold base 31.

The present invention contemplates that the base center member 33 has an upper surface 34 which is stylistically shaped to form the outboard face of the disc portion of the wheel casting. The upper surface 34 extends radially in an outward direction to include a portion of the outboard tire retaining flange. Thus, the upper surface 34 includes essentially the entire outboard face of the vehicle wheel.

Figure 5:
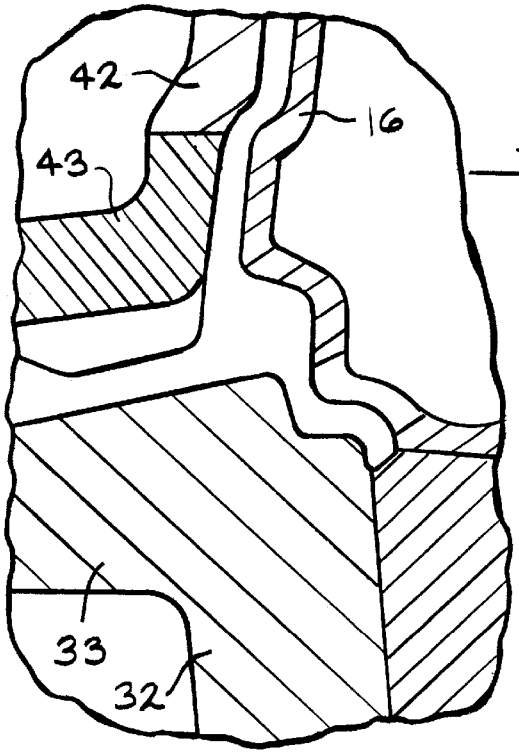
FIG. 5 is a partial sectional view of the wheel mold shown in FIG. 3 which illustrates an alternate structure for the joint formed between the modular components.
Figure 6:
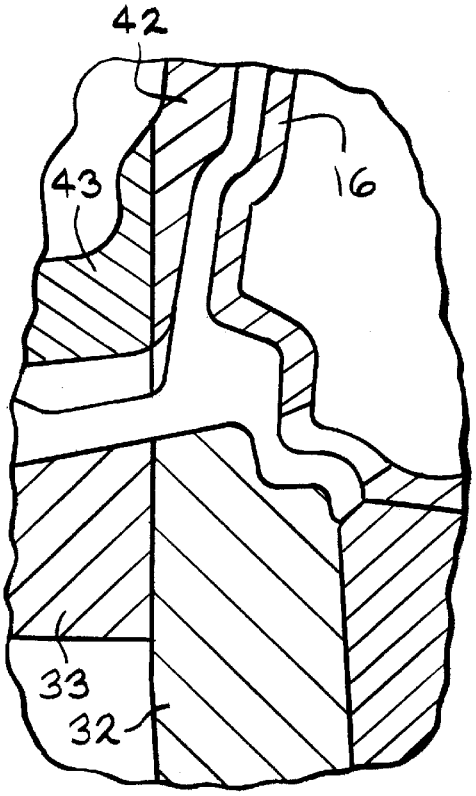
FIG. 6 is a partial sectional view of the wheel mold shown in FIG. 3 which illustrates another alternate structure for the joint formed between the modular components.
Figure 7:
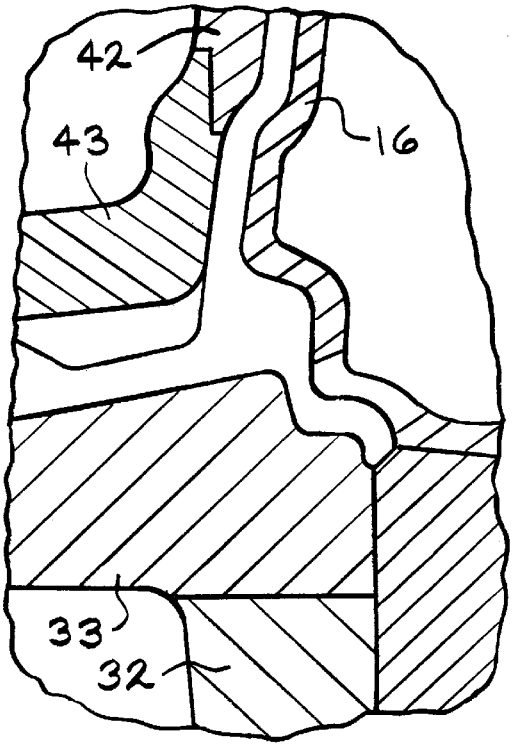
FIG. 7 is a partial sectional view of the wheel mold shown in FIG. 3 which illustrates another alternate structure for the joint formed between the modular components.

In the preferred embodiment, the edges of the center member 33 are beveled to form a seal with the support member 32; however, other mechanical fitting methods, such as, for example, cylindrical or flat surfaces, also may be used. Several such optional joints are illustrated in FIGS. 5 through 7. In FIG. 5, horizontal flat surfaces form the joint while in FIG. 6, vertical cylindrical surfaces do so. In FIG. 7, a stepped joint is formed between the base center member 33 and the base support member 32. It will be appreciated that the beveled and stepped joints function to guide the center member 33 into position upon the support member 32. The present invention further contemplates a plurality of interchangeable center members 33 which have the same outside diameter and mounting structure, but different stylized shapes which correspond to different wheel designs.

The mold 30 further includes a pair of movable side members 15 and 16 which are supported by the base 11. While two side members 15 and 16 are shown in FIG. 3, it will be appreciated that the mold 10 can include more than two side members. The side members 15 and 16 are movable in a horizontal direction in FIG. 3 and can be extended to a closed position, which is illustrated in FIG. 3, or retracted to an open position by a conventional mechanism which, for clarity, is not shown in FIG. 3. The side members 15 and 16 are shown partially retracted in FIG. 4. The side member 16, which is shown on the right in FIG. 3, has a gate 17 formed therein. A plurality of passageways extend from the gate 17 through the inner surface of the right side member 16.

The mold 30 also includes a cup-shaped top core 40 which is disposed between the side members 15 and 16. The top core 40 includes a hollow ring-shaped universal top core member 42 which is tapered and open upon both ends. The top core 40 also includes a removable disc-shaped end member 43 which is mounted upon the lower end of the top core member 42 and forms the bottom thereof. In the preferred embodiment, the edges of the end member 43 are beveled to form a seal with the top core member 42; however, other mechanical fitting methods, such as, for example, cylindrical or flat surfaces, as shown in FIGS. 5 through 7, also may be used. Several such optional joints are illustrated in FIGS. 5 through 7. In FIG. 5, horizontal flat surfaces form the joint while in FIG. 6, vertical cylindrical surfaces do so. In FIG. 7, a stepped joint is formed between the top core member 42 and the top core end member 43.

Also in the preferred embodiment, the end member 43 is secured to the top core member 42 with conventional threaded fasteners (not shown); however, other conventional methods can be utilized to secure the end member 43 to the top core member 42. Alternately, the end member 43 can be clamped to the top core member 42. As shown in FIG. 3, additional mold components can be attached to the top core and end members 42 and 43 of the top core 40.

The present invention contemplates that the end member 43 has a lower surface 44 which is stylistically shaped to form the inboard face of the disc portion of the wheel casting. The lower surface 44 extends radially in an outward direction to include a portion of the inboard end of the wheel rim. Thus, the lower surface 44 includes the entire inboard face of the wheel disc. The present invention further contemplates a plurality of interchangeable end members 43 which have the same outside diameter and mounting structure, but different stylized shapes which correspond to different wheel designs.

When the modular mold 30 is closed, as shown in FIG. 3, the mold 30 defines a mold cavity 25 having a rim cavity 26 for forming the rim portion of the vehicle wheel and a disc cavity 27 for forming the disc portion of the vehicle wheel. The mold cavity 25 communicates with the gate 17 through the passageways formed in the right side member 16. During casting, molten metal flows from the gate 17 into the mold cavity 25 and fills the rim and disc cavities 26 and 27. Following solidification of the molten metal in the mold cavity 25, the side members 15 and 16 and top core 40 are fully retracted to allow removal of the wheel casting from the mold base 31.

As can best be seen in FIG. 3, the side members 15 and 16 co-operate with the universal top core member 42 to form the rim portion of the wheel casting (not shown). Accordingly, the modular mold 30 can be utilized to cast a family of wheels having the same diameter and rim shape but different stylized wheel discs by mounting different interchangeable base center members 33 and corresponding interchangeable top core end members 43 upon the universal base support member 32 and the universal top core member 42. Thus, the majority of the wheel mold components could be used to cast wheels having different stylized disc portions.

Additionally, the geometry of a permanent wheel mold affects the cooling of the molten metal contained within the mold cavity. The contemplated invention allows rapid and inexpensive changes of the critical mold components to optimize the mold geometry and thus enhance the cooling characteristics of the mold and the quality of the casting produced therewith before commencing mass production of vehicle wheels with the mold.

The inventor expects that the invention will reduce the time required to fabricate a wheel mold from 20 to 30 weeks to approximately 6 to 8 weeks, allowing faster production of prototype wheels. In addition to reducing the time required to produce a prototype wheel, the inventor also expects a significant reduction in costs since only the base center member 33 and top core end member 43 would need to be fabricated to cast a wheel having a different appearance. Furthermore, if the wheel is produced in quantity, only the base center members 33 and the top core end members 43 need to be produced for the set of wheel molds needed for the automated casting machine. Thus, the mold storage requirements between production runs is reduced.

While the mold 30 shown in FIGS. 3 and 4 is designed for gravity casting one piece vehicle wheels, it will be appreciated that the invention also can be practiced on a mold for gravity casting a wheel component, such as a wheel disc or a wheel spider, and on molds utilized with other conventional casting methods such as, for example, low pressure casting, high pressure die casting and injection casting. Furthermore, the molds and dies described above also can be used to form a wheel component, such as a full face wheel disc or a wheel spider. Molds for wheel discs or spiders (not shown) would not include side members. Finally, while the invention has been illustrated and described in terms of a mold for casting wheels, it will be appreciated that the invention also can be practiced upon multiple-piece wheel dies (not shown) utilized in forging vehicle wheels or vehicle wheel components.

It also will be appreciated that the invention can be practiced with different structures for the base member and top core assemblies. While the preferred embodiment includes a base center member mounted upon a ring shaped base support member, it is also possible to mount a disc shaped base center member upon an inverted cup-shaped base support member. This alternate structure assures that molten metal does not seep through the seam between the base center member and the base support member. Similarly, is possible to practice the invention by mounting a top core end member upon a cup-shaped top core which has a closed end, rather than the open end illustrated in the figures.

Figure 8:
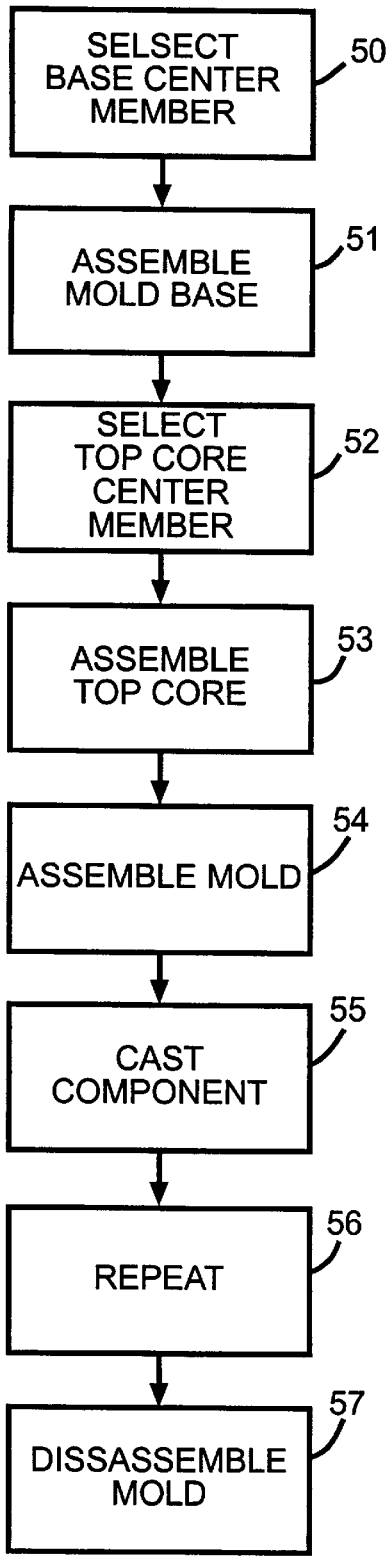
FIG. 8 is a flow chart illustrating a process for forming a vehicle wheel which utilizes a modular wheel mold.

The invention also contemplates a process for forming a wheel or wheel component which utilizes the modular wheel mold described above. The process is illustrated by the flow chart illustrated in FIG. 8. In functional block 50, a base center member is selected from a plurality of interchangeable base center members. The selected base center member is mounted upon a universal base support member in functional block 51 to form a base member assembly. Similarly, a top core center member is selected from a plurality of interchangeable top core center members in functional block 52. In functional block 53, the selected top core center member is mounted upon the universal top core member to form a top core assembly.

The top core assembly and base member assembly are combined with side members in functional block 54 to form a wheel mold. In functional block 55, a vehicle wheel is cast in the assembled wheel mold by a conventional casting process, such as gravity casting, low pressure casting or high pressure die casting. The casting process is repeated in functional block 56 until the desired number of wheels has been cast. The mold is then disassembled in functional block 57 which makes the universal base support member and universal top core member available to be recombined with other base center members top core center members to form wheels having other stylized wheel discs.

While the process above has been illustrated and described for casting a wheel, it will be appreciated that the process also can be practiced to cast a wheel component or to forge a wheel or a wheel component.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, while the preferred embodiment of the invention has been illustrated and described as having interchangeable base center members and interchangeable top core end members, it is also possible to practice the invention with molds or dies having only one of these features. Thus, an assembled base member having an interchangeable base center member mounted upon a universal base support member and can cooperate with a conventional top core, for changing the shape of only the outboard surface of the wheel disc. Similarly, an assembled top core having an interchangeable end member mounted upon a universal top core member can cooperate with a conventional base member to provide for changing the shape of the inboard surface of the wheel disc to match the outboard shape and/or optimize cooling of the mold and casting.

What is claimed is:

1. A multiple piece form for forming a vehicle wheel component comprising:

a universal ring-shaped base support member;

a removable disc-shaped base center member mounted upon said base support member, said base center member including a surface having a stylized shape, said base center member and said base support member cooperating to form a base member assembly; and a top core member whereby said base member assembly cooperates with said top core member to form a stylized wheel component.

2. A vehicle wheel form according to claim 1 wherein said base center member is one of a plurality of interchangeable base core members.

3. A vehicle wheel form according to claim 2 wherein said top core member includes a stylized top core end member mounted upon a universal annular top core member, said top core end member cooperating with said universal top core member to form a top core assembly.

4. A vehicle wheel form according to claim 3 wherein said top core end member is one of a plurality of interchangeable top core end members.

5. A vehicle wheel form according to claim 4 wherein said base center member includes a beveled edge and further wherein said base support member includes a beveled edge which is complementary to said beveled edge of said base center member, said base center member beveled edge cooperating with said base support member beveled edge to form a joint between said base center member and said base support member.

6. A vehicle wheel form according to claim 4 wherein said base center member includes a stepped edge and further wherein said base support member includes a stepped edge which is complementary to said stepped edge of said base center member, said base center member stepped edge cooperating with said base support member stepped edge to form a joint between said base center member and said base support member.

7. A vehicle wheel form according to claim 5 wherein said base member assembly cooperates with said top core assembly to form a mold for casting a vehicle wheel disc.

8. A vehicle wheel form according to claim 5 further including a plurality of side members, said side members cooperating with said base member assembly and said top core assembly to form a mold for casting a vehicle wheel.

9. A vehicle wheel form according to claim 5 wherein said base member assembly cooperates with said top core assembly to form a die set for forging a vehicle wheel disc.

10. A vehicle wheel form according to claim 5 further including a plurality of side members, said side members cooperating with said base member assembly and said top core assembly to form a die set for forging a vehicle wheel.

* * * * *